US008739721B2

(12) United States Patent
Lennon et al.

(10) Patent No.: US 8,739,721 B2
(45) Date of Patent: Jun. 3, 2014

(54) RADIAL SAIL WITH REINFORCED LUFF TUBE

(75) Inventors: Michael Lennon, Loughton (GB); Ian Cameron MacDiarmid, Glebe (AU)

(73) Assignee: International Laser Class Association, Falmouth (GB)

( * ) Notice: Subject to any disclaimer, the term of this patent is extended or adjusted under 35 U.S.C. 154(b) by 0 days.

(21) Appl. No.: 12/964,156

(22) Filed: Dec. 9, 2010

(65) Prior Publication Data

US 2012/0145063 A1 Jun. 14, 2012

(51) Int. Cl.
*B63H 9/06* (2006.01)

(52) U.S. Cl.
USPC ..... 114/102.33; 114/102.29

(58) Field of Classification Search
USPC ..... 114/102.1, 102.29, 102.31, 102.33, 90, 114/39.12; D12/317
See application file for complete search history.

(56) References Cited

U.S. PATENT DOCUMENTS 3,954,076 A * 5/1976 Fracker ..... 114/102.33
3,996,868 A * 12/1976 Schagen ..... 114/39.14
4,665,854 A 5/1987 Meyer
4,702,190 A 10/1987 Conrad
7,658,160 B2 2/2010 Skinner et al.
2010/0275828 A1 11/2010 Stein et al.

FOREIGN PATENT DOCUMENTS

DE 33 45 043 6/1985
EP 0 224 729 6/1987
FR 2 581 021 10/1986
FR 2581021 A1 * 10/1986 ..... B63H 9/06

OTHER PUBLICATIONS http://web.archive.org/web/20041117074627/http://www.hksailmakers.com/headsails.htm Hong Kong Sailmakers publication Nov. 17, 2004.*
Dickison, D.;"Cross Cut vs. Radial Sail Construction"; www.fxsails.comisailchoicearticle.php; retrieved from Internet Nov. 18, 2010.
ILCA By-Law 1:Rules (Parts one to five inclusive); pp. 36-54; Jan. 1, 2010.
International Search Report and Written Opinion of PCT/GB2011/001706 dated Apr. 5, 2012.

* cited by examiner

*Primary Examiner* — Edwin Swinehart
(74) *Attorney, Agent, or Firm* — Cesari and McKenna, LLP

(57) ABSTRACT

A generally triangular-shaped, radial-cut sail intended for use with a small sailing craft such as a Laser™ Class sailboat. A mast sleeve or "luff tube" is arranged or formed adjacent the luff area of the sail, extending from the head to the foot, and sized to accommodate a flexible mast formed of two or more mast sections. A luff tube patch is placed on the leading edge of the mast sleeve adjacent a point where the mast sections meet when the sailing rig is assembled.

8 Claims, 5 Drawing Sheets

RADIAL SAIL WITH REINFORCED LUFF TUBE

RELATED APPLICATION(S)

This application is related to a U.S. Design patent Ser. No. 29/380,679 entitled "Radial Sail" filed on the same day herewith (Dec. 9, 2010), now issued as U.S. Pat. No. D664,493. The entire teachings of the above application(s) are incorporated herein by reference.

BACKGROUND OF THE INVENTION

This patent application broadly relates to a sail intended to be used with a small to sailing craft, and more specifically to a radial sail for use with an unstaged, non-braced mast.

Modern sailing craft are typically equipped with a triangular-shaped main sail connected along its luff to a mast. A clew of the sail is attached to the aft end of a boom, the boom being held at its forward end to the mast. Many small sailing-craft, such as dinghies, sailboards, and Laser™ class sailboats have neither jib sails nor mast stays. The free-standing masts of these so-called cat-type rigs can therefore be subject to extreme forces. Even when initially setting the sail, the requisite preloading causes the mast to deflect considerably. Under way while sailing, the influence of the wind causes increases mast deflection, and the sail shape further changes unfavorably.

In order to keep undesirable sail deformation within acceptable limits, it has been one practice to use thicker masts with large cross-sections. But placing a thick mast along the leading edge of a sail affects aerodynamic efficiency quite unfavorably, not only by slowing down the air flow but also by creating turbulence, which in turn destroys suction on the leeward side of the sail. In order to avoid these disadvantages there has been a move towards using thinner masts, with the attendant disadvantage of more mast deflection and even possible mast failure.

By and large, sails are made by sewing together a number of cloth panels. Dacron, a trade name for polyester fibers manufactured by DuPont, is one popular is sailcloth material. However, other woven or laminated fibers or materials can often be used.

When it comes to sails built from panels of cloth, there are two basic types of construction: cross-cut and radial-cut. Cross-cut sails are ordinarily made from multiple overlapping fabric panels with the seams between each panel oriented in a fore and aft direction, parallel to each other and perpendicular to the leech. In most cases, the cross-cut panels are rectangular or almost rectangular in shape.

The fabric panels that make up radial-cut sails, on the other hand, are usually oriented toward the corners of the sail. This means that the seams between panels are not parallel, but rather radiate out from the corners of the sail. This results in panels that are triangular or nearly triangular in shape.

From the perspective of a sailmaker it is measurably more efficient to build cross-cut sails than to build radial-cut sails. With broad, almost rectangular cross-cut panels, there is less material waste than with the triangular-shaped panels needed for radial construction. Thus, cross-cut sails tend to be less expensive.

In particular, radial-cut panels must typically be oriented such that the direction to of highest stretching resistance extends in the same direction as the principal load lines of the sail. This manufacturing method entails significant waste and thus makes manufacture more costly. However, their strength and load-carrying ability mean that radial sails are generally thought to have superior performance over cross-cut sails.

SUMMARY OF THE INVENTION

What is needed is a way to provide a radial-cut sail that can provide increased strength and also reduce or even eliminate undesirable distention in sail shape that can result from loading imposed by an unstaged, sectional mast.

In one configuration, the present invention is a generally triangular-shaped, radial-cut sail intended to be used with a small sailing craft such as a Laser™ Class sailboat. A mast sleeve is arranged adjacent the luff area of the sail, extending from the head to the foot of the sail. The mast sleeve is sized to accommodate a flexible, free-standing mast formed of two sections. A luff patch is placed on the leading edge of the mast sleeve adjacent a point where the two mast sections meet.

In certain configurations, the sail may be formed from two sections, each of radial-cut design. One section joins the other lower section at a longitudinal joint. The longitudinal joint may have a forward end near the luff patch and/or other location is where the mast sections meet.

The resulting sail with luff patch exhibits far less wrinkling than previous designs while also providing all of the advantages of radial-cut configuration.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF A PREFERRED EMBODIMENT

A description of example embodiments of the invention follows.

Turning attention more specifically to the drawings, it is to be understood that to simplify the showing thereof only enough of the structure of the radial sail and an associated sailing rig has been illustrated therein as is needed to enable one skilled in the art to readily understand the underlying principles and concepts of this invention as recited in the appended claims.

Figure 1:
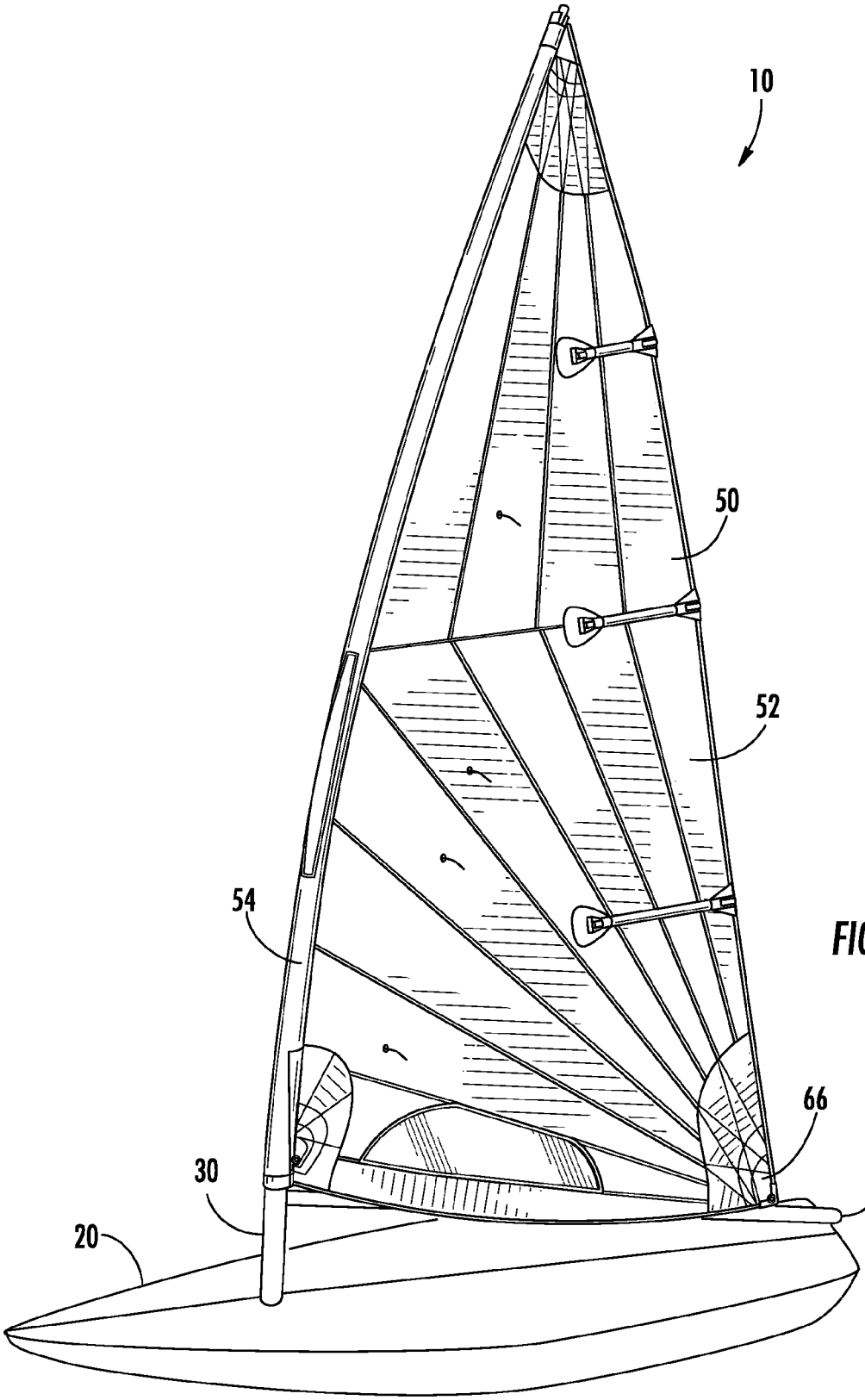
FIG. 1 is a perspective view of a Laser™ Class sailboat with a rig that includes a radial-cut sail according to one embodiment.

FIG. 1 shows a sailing rig 10 that has a sail 50 configured according to principles of one implementation of the invention as claimed herein. The sail 50 is generally formed of a number of fabric panels 52 arranged in a bi-radial configuration that will be described in much greater detail below. The sail 50 is intended to be used with small sailing craft 20, particularly a Laser™ Class sailboat. A Laser sailboat generally consists of a hull 20, a freestanding mast 30 and single boom 40. The mast 30 of a Laser sailboat includes two mast sections that join at a mast collar (see FIG. 4) The is exact layout of the panels 52 that make up the sail 50 can be made specific to Laser™ Class characteristics, although the general design principles explained herein may well be applicable to other types or classes of sailing craft.

To be used with Laser™ Class sailboats, the sail 50 includes a generally hollow, cylindrical mast sleeve or "luff tube" part 54 that fits over the mast 30. The sail 50 is also attached to the boom 40 at a clew 66. Three batten pockets 70 provide support for tapered battens.

Figure 2:
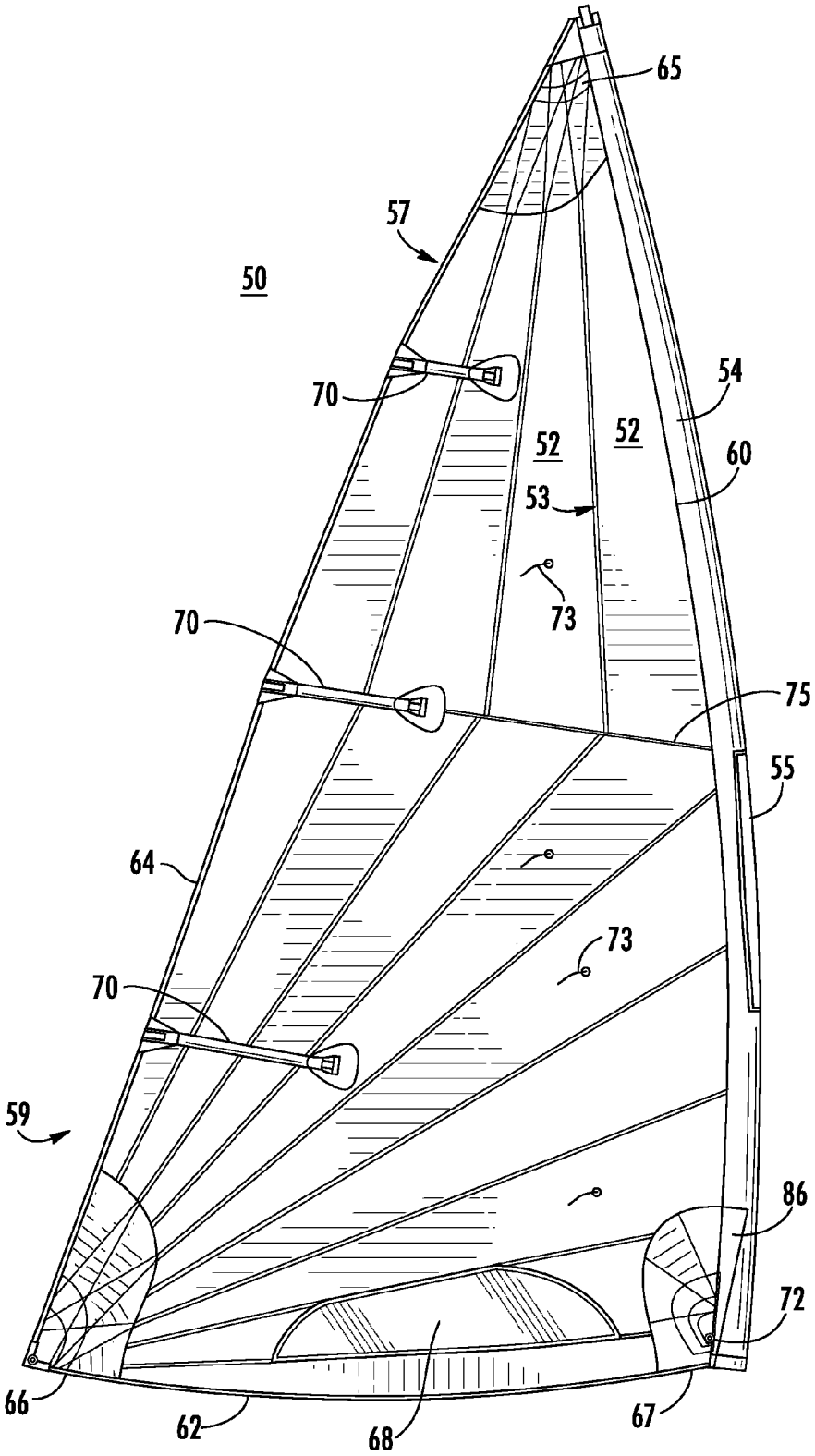
FIG. 2 is a more detailed plan view of the sail of FIG. 1.

FIG. 2 is a more detailed view of the sail 50. As with all triangular sails, the uppermost point is known as the head 65, and the lower two corners of the sail 50 on either end of the foot 62 include a tack 67 (the forward end) and the clew 66 (the rear or aft end). The foot 62 of the sail 50 is bound at its lower edge by the tack 67 and clew 66. The forward or leading edge of the sail 50 is the luff 60. The aft or rear end of the sail is the leech 64. A number of tell-tales 73 may be placed on various panels 52 of the sail. A window 68 is placed in one of the panels 54, in this design it is placed in the panel adjacent the lowest panel, providing increased visibility for the skipper.

In the case of a Laser Class sail, the tack 67 is integrally attached to the luff tube 54. A Cunningham eyelet 72 may be placed on or in the tack 67, to enable further adjustment of the tension on sail 50.

The bi-radial construction of the sail arranges groups of panels 52 into two sections, an upper section 57 and a lower section 59. The panels 52 generally have overlap with one or more adjacent panels and are sewn together to form seams such as is an example seam 53 at such joints. One particular longitudinal seam 75 runs more or less horizontally between the luff 60 and leach 64 in an area generally near the middle of mast 30.

Of note to this sail design is the use of a luff patch 55, also located in the same general area as longitudinal seam 75 and/or where the two sections of mast 30 join together.

Figure 3:
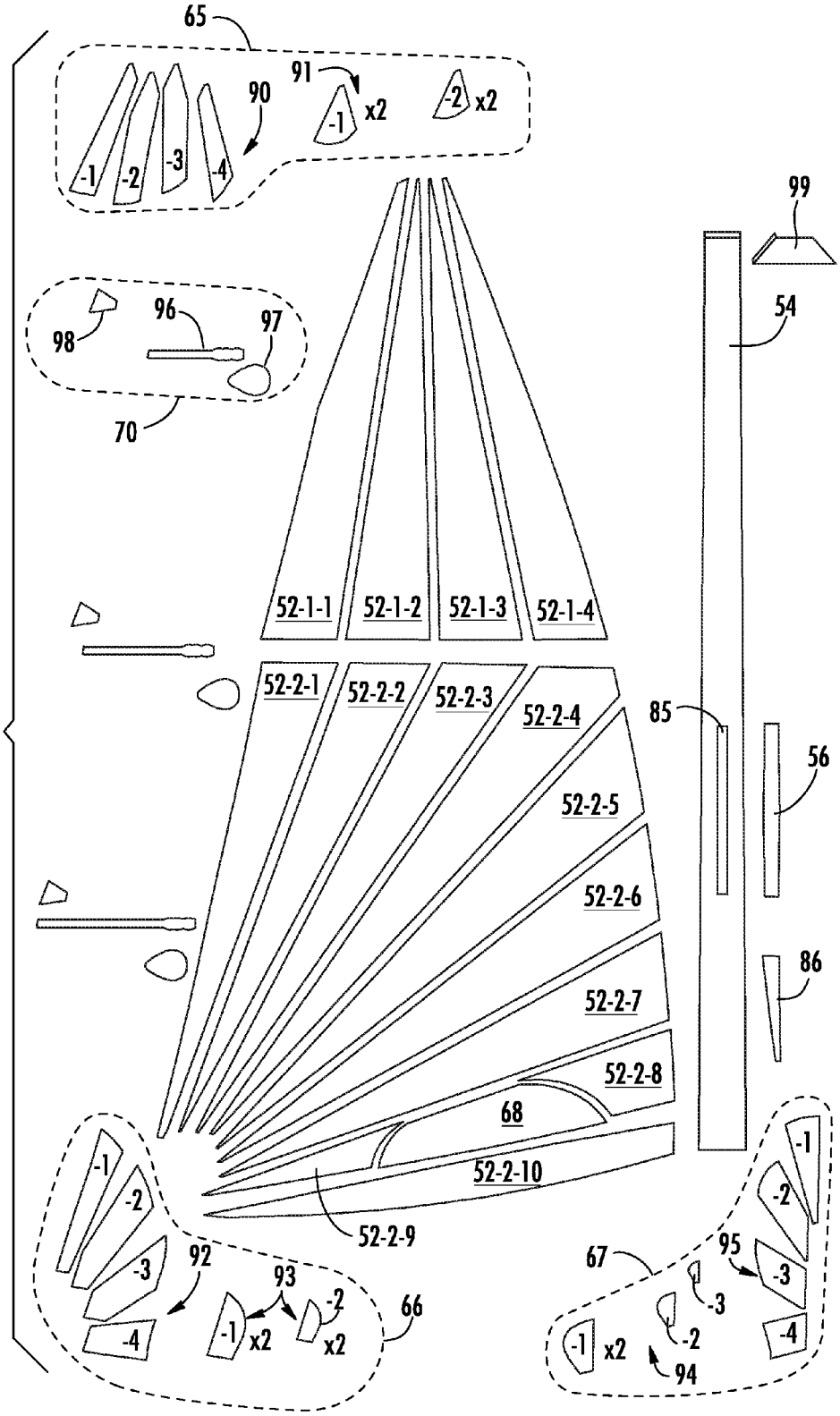
FIG. 3 illustrates a layout of various fabric panels that are sewn together to construct the sail.

A more particular layout of each of the panels 52 after they are cut but before being sewn together to form sail 50 is shown in FIG. 3. The exact panel 52 layout and shapes shown are specific to the characteristics of the Laser mast 30, being determined primarily by the expected load distribution of the specified 4.5 or Dacron™ sail cloth, with some consideration given to mast size and production costs. All panels, patches, and pieces shown in FIG. 3 are generally formed of 4.5 ounce (oz) Dacron™.

Several features are believed to be unique and specific for use with the Laser sailboat hull 20. One such important characteristic is the luff tube mast joint patch 55 having a purpose to remove a diagonal "wrinkle" that Laser sails tend to have. This diagonal wrinkle tends to run in a direction from a mast joint collar to the clew 66.

More specifically shown in FIG. 3 is the division of the bi-radial sail 50 into the upper panels 52-1 that comprise upper section 57 and lower panels 52-2 that comprise lower section 59.

Upper section 57 generally include four such panels 52-1-1, 52-1-2, . . . 52-1-4 of radial design extending from longitudinal joint 75 up to head 65. Lower section 59 includes panels 52-2-1, 52-2-2, . . . 52-2-10. These panels generally extend from the clew 66 up towards the longitudinal joint 75 and over to the lower part of luff 60.

Other features include reinforcement patches (90, 91) (92, 93) (94, 95) at the corners, at head 65, tack 67 and clew 66 respectively. These are provided to increase the overall lifetime of the sail 50. More specifically, reinforcements 90, 91 are provided for head section 65. A first type of reinforcement 90 includes four patches 90-1, 90-2, 90-3, 90-4, each such reinforcing patch overlapping at least two of the main radial panels 52-1. Additional triangular pieces 91-1 and 91-2 are used on either side of the head 65 to reinforce the very topmost portion of sail 50. Reinforcement pieces 91-1 and 91-2 may include two generally overlapping pieces. Layout of the assembled reinforcement patches 90 and pieces 91 that make up head 65 is best seen by referring back to FIG. 2.

Similarly, reinforcement patches 92-1, 92-2 . . . 92-4 are provided to the clew 66. Each main clew reinforcement patch 92 overlaps at least two of the adjacent radial panels 52-2. Smaller reinforcement pieces 93-1, 93-2 are also provided to the clew 66.

Reinforcement is also provided for tack 67 in the same way, including main reinforcement patches 95 and associated smaller pieces 94-1, 94-2, 94-3, 94-4.

An additional reinforcement patch 86 on the forward edge of tack 67 further strengthens tack 67 where it meets luff tube 54.

Figure 4:
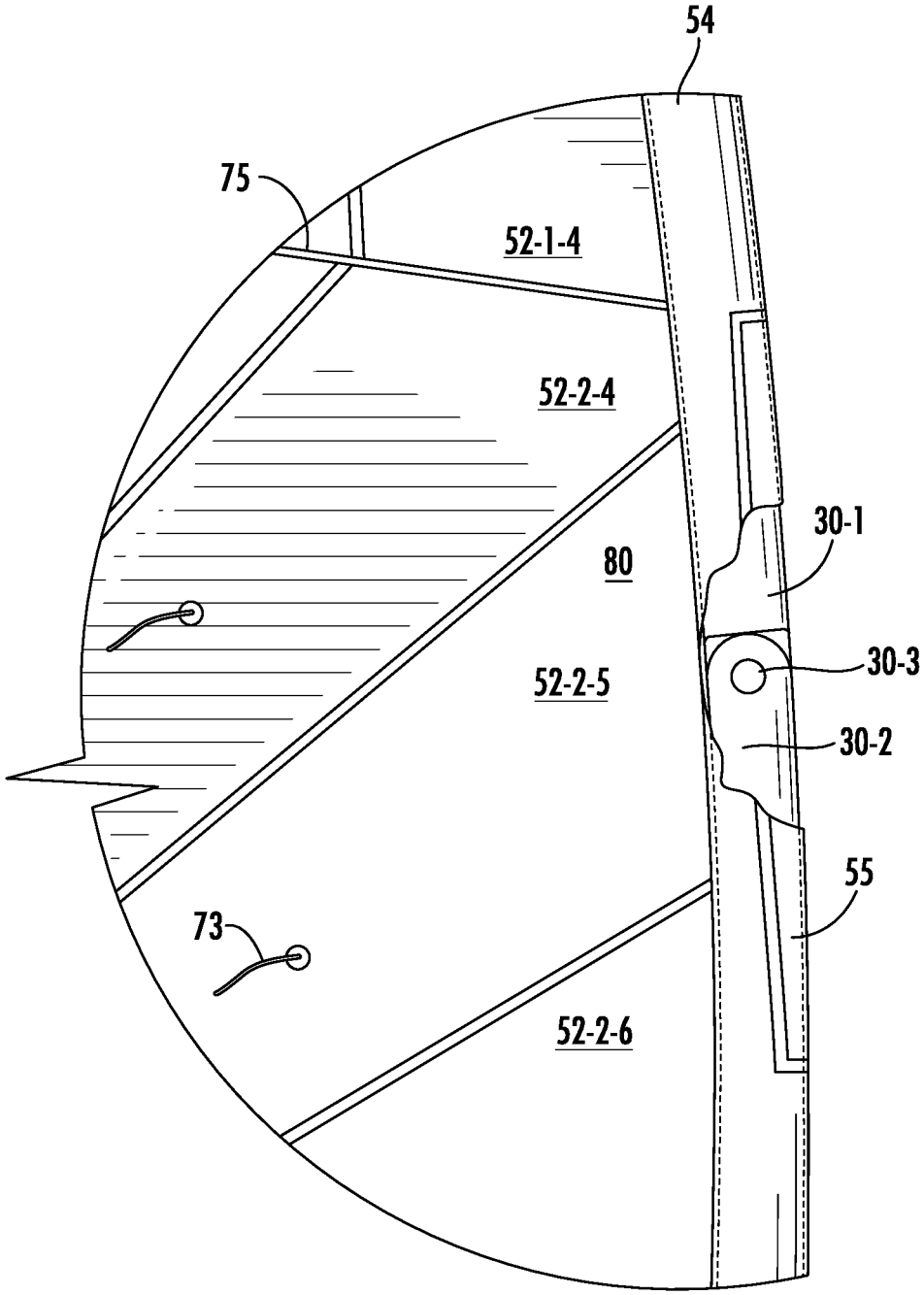
FIG. 4 is a detailed cut-away view of the rig adjacent where two mast sections join.

FIG. 4 shows more detail of the luff tube joint patch 55. As explained above, luff tube 54 generally has a cylindrical shape sized to snugly fit over the mast 30. Here are seen the upper mast section 30-1 and lower mast section 30-2 joined together at fastening collar 30-3, to form the assembled mast 30.

At about the middle portion of the luff tube 54 (adjacent sections 52-2-4 and 52-2-5) is a cut-out portion 85 over which the luff tube joint patch 55 is placed. Luff tube joint patch 55 is located in the general area 80 near where mast sections 30-1, 30-2 meet. In the same general area 80 are found panels 52-1-4 from the upper section 57 and panel 52-2-4, 52-2-5 and 52-2-6 from the lower section 57. Note that longitudinal seam 75 attaches to luff tube 54 in the area adjacent the top portion of patch 55, above a point where mast sections 30-1 and 30-2 join.

Figure 5:
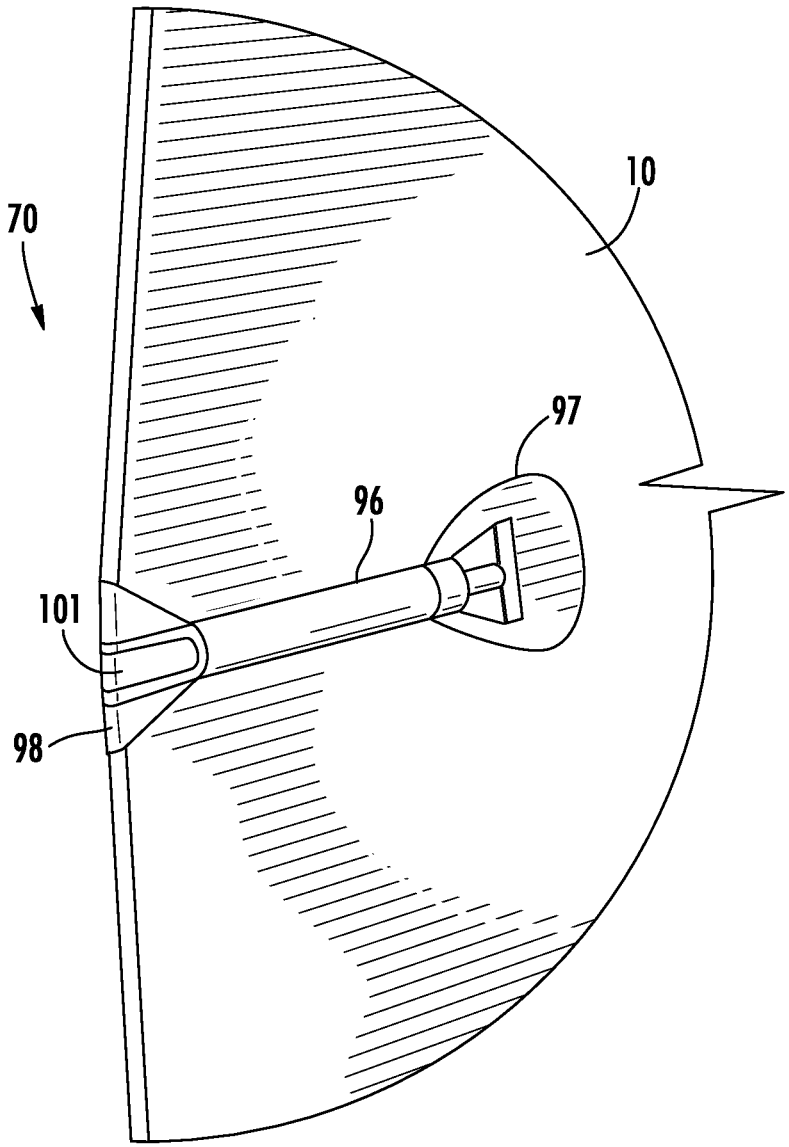
FIG. 5 is a more detailed view of a batten pocket.

FIG. 5 is a more detailed view of one of the batten pockets 70. The batten pockets 70 may take one of three positions along the leach 64 as shown in FIG. 1. A batten pocket 70 generally consists of a main batten panel 96, a batten pocket reinforcement 97 and batten pocket end 98 piece. A VELCRO® flap 101 may be placed around the end of the pocket to keep the batten 70 in place in the batten pocket.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A sail having a generally triangular shape, with a head portion at a top, a foot portion at a bottom, a tack portion at a forward end of the foot, a clew portion at an aft end of the foot, and a tuff portion extending from the head to the forward end of the foot, the sail further comprising:

a plurality of bi-radially cut panels, the panels generally arrange as an upper radial section and a lower radial section, the upper radial section comprising some of the plurality of panels, and the lower radial section comprising other ones of the plurality of panels, with the panels forming the upper radial section and the lower radial section overlapping along a longitudinal seam;

the panels in the upper radial section generally running from the longitudinal seam to the head, and the panels in the lower radial section generally running from the clew to the longitudinal seam and to and to a lower portion of the luff;

a luff tube attached along the tuff, the tuff tube shaped to accommodate a mast formed of two mast sections that fit together at a mast joint;

the longitudinal seam extending to a location on the luff tube above the mast joint;

a tuff tube patch disposed on the luff tube adjacent the luff, the longitudinal seam and the mast joint; and further wherein the luff tube has a cut-out in a center portion thereof, and the luff tube patch is positioned over the cut-out.

2. The apparatus of claim 1, wherein the top radial section comprises four radial cut panels.

3. The apparatus of claim 1, wherein the bottom radial section comprises at least eight radial cut panels.

4. The apparatus of claim 1, wherein at least one of the head, clew or tack are reinforced by additional pieces of sail cloth overlapping at least two of the adjacent radial panels.

5. The apparatus of claim 1, wherein the tack includes an additional panel attached to both the tack and the luff tube at a lower portion of the luff tube.

6. The apparatus of claim 1 wherein the panels in the lower radial section increase in thickness with distance from the clew towards the luff.

7. A sail having a generally triangular shape, with a head portion at a top, a foot portion at a bottom, a tack portion at a forward end of the foot, a clew portion at an aft end of the foot, and a tuff portion extending from the head to the forward end of the foot, the sail further comprising:

a plurality of bi-radially cut panels, the panels generally arranged as an upper radial section and a lower radial section, the upper radial section comprising some of the plurality of panels, and the lower radial section comprising other ones of the plurality of panels, with the panels forming the upper radial section and the lower radial section overlapping along a longitudinal seam;

the panels in the upper radial section generally running from the longitudinal seam to the head, and the panels in the lower radial section generally running from the clew to the longitudinal seam and to a lower portion of the luff;

a luff tube attached along the luff, the luff tube shaped to accommodate a mast formed of two mast sections that fit together at a mast joint;

the longitudinal seam extending to a location on the luff tube above the mast joint;

a luff tube patch disposed on the luff be adjacent the luff, the longitudinal seam, and the mast joint; and further wherein the longitudinal seam is attached to a top portion of the luff tube patch.

8. The apparatus of claim 7, wherein the luff tube patch is further aligned with the longitudinal seam such that the luff tube patch is located on the luff tube below where the longitudinal seam extends to the luff tube.

* * * * *

UNITED STATES PATENT AND TRADEMARK OFFICE

CERTIFICATE OF CORRECTION

PATENT NO. : 8,739,721 B2
APPLICATION NO. : 12/964156
DATED : June 3, 2014
INVENTOR(S) : Michael Lennon et al.

It is certified that error appears in the above-identified patent and that said Letters Patent is hereby corrected as shown below:

In the claims:
Claim 1, Col. 4, line 57 should read:
and a luff portion extending from the head to the forward end Claim 1, Col. 5, line 4 should read:
a luff tube attached along the luff, the luff tube shaped to Claim 1, Col. 5, line 9 should read:
a luff tube patch disposed on the luff tube adjacent the luff, Claim 7, Col. 6, line 1 should read:
and a luff portion extending from the head to the forward end Claim 7, Col. 6, line 20 should read:
a luff tube patch disposed on the luff adjacent the luff, Signed and Sealed this
Twenty-ninth Day of March, 2016

Michelle K. Lee

Michelle K. Lee
*Director of the United States Patent and Trademark Office*